United States Patent [19]

Ciecior

[11] 4,108,096

[45] Aug. 22, 1978

[54] NEEDLE BAR DRIVE STABILIZING ARRANGEMENT

[75] Inventor: Heinrich Ciecior, Ettlingen, Fed. Rep. of Germany

[73] Assignee: The Singer Company, New York, N.Y.

[21] Appl. No.: 797,101

[22] Filed: May 16, 1977

[51] Int. Cl.[2] ..... D05B 55/14

[52] U.S. Cl. ..... 112/221

[58] Field of Search ..... 112/221, 220, 210, 212, 112/213, 158 R

[56] References Cited

U.S. PATENT DOCUMENTS

| | | | |
|---|---|---|---|
| 3,011,462 | 12/1961 | Ritter et al. | 112/210 |
| 3,460,498 | 8/1969 | Eguchi et al. | 112/221 |
| 3,641,955 | 2/1972 | Brown et al. | 112/221 X |
| 3,779,187 | 12/1973 | Adams | 112/221 X |
| 3,799,090 | 3/1974 | Sheroff | 112/221 |
| 3,919,952 | 11/1975 | Lund | 112/221 X |
| 4,037,548 | 7/1977 | Hirayama et al. | 112/221 X |

*Primary Examiner*—Werner H. Schroeder
*Assistant Examiner*—Moshe I. Cohen
*Attorney, Agent, or Firm*—Robert E. Smith; Edward E. Bell; J. Falk

[57] ABSTRACT

A drive mechanism for reciprocating a sewing machine needle bar endwise from an actuating crank is disclosed in which the lateral stud on the needle bar to which the drive link is connected is fitted with a ball bearing slidably constrained in a guide slot formed parallel to the path of needle reciprocation in a stationary guide frame. The forces and reactions occasioned by alternate acceleration and decelleration during each needle bar stroke will cause the outer race of the ball bearing to engage first one side then the opposite side of the guide slot during each stroke thus turning the bearing in opposite directions and distributing the wear.

1 Claim, 4 Drawing Figures

NEEDLE BAR DRIVE STABILIZING ARRANGEMENT

BACKGROUND OF THE INVENTION

This invention relates to a stabilizing arrangement for the needle bar reciprocating mechanism of a sewing machine.

In sewing machine construction, it is very well known to reciprocate the needle carrying bar endwise by utilizing a crank mechanism in which a connecting link at one extremity embraces a crank pin and at the other extremity embraces a drive pin secured transversely on the needle bar.

Particularly in high speed sewing machines, it has been known to stabilize the needle bar driving mechanism by providing on the drive pin which is secured transversely on the needle bar, a slide block which is constrained in a slotted guide carried by the machine frame. The German Gebrauchsmuster 7,236,562, Oct. 5, 1972, discloses such a stabilizing slide block construction In this known stabilizing slide block construction, however, comparatively high sliding friction forces are encountered, and particularly at the extremities of needle bar stroke, static friction forces arise which disadvantageously increase the power requirements of a sewing machine equipped with this known type of stabilizing means.

SUMMARY OF THE INVENTION

The present invention solves the problem of providing an adequate needle bar drive stabilizing arrangement without increasing the power requirements of the sewing machine. The problem is solved by providing a cylindrical antifriction bearing, such as a ball bearing or a roller bearing, between the drive pin which is secured transversely on the needle bar and a guide track carried by the sewing machine frame. Since only rolling line contact occurs between the guide track and the cylindrical antifriction bearing, power requirements are minimized.

Because of the reaction of forces which are exerted by and upon a needle bar drive arrangement built in accordance with this invention, the cylindrical antifriction bearing will be shifted periodically into tracking relationship with the opposite sides of the guide track thus periodically reversing the direction of rotation of the antifriction bearing which changes the locale of line contact of the cylindrical antifriction bearing with the guide track and consequently distributes the wear incident to the operation of this arrangement about the cylindrical bearing.

As a result, the present invention provides a needle bar stabilizing arrangement which consumes less energy and which involves less wear of the parts during sewing machine operation than constructions which had been known heretofore.

Because of the arrangement of parts associated with the needle bar stabilizing arrangement of this invention, a slight precessing of the outer relatively to the inner race of the cylindrical antifriction bearing is caused particularly at the extremities of the needle bar stroke thus further influencing the distribution of the wear evenly over the entire bearing and contributing more favorably to long life of the construction of this invention.

DETAILED DESCRIPTION OF THE INVENTION

Figure 1:
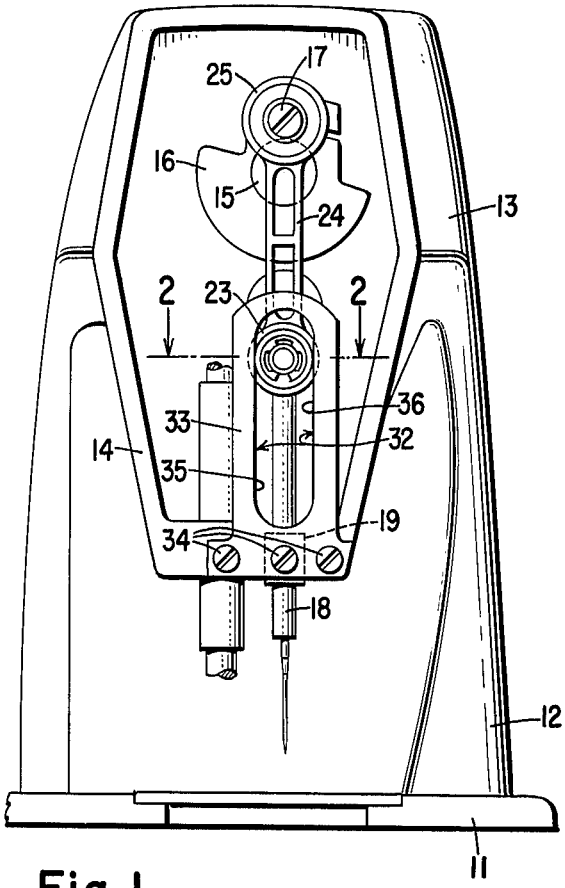
FIG. 1 is a front elevational view of a sewing machine bracket arm with the end cover plate and the presser mechanism of the sewing machine removed more clearly to illustrate the needle bar drive stabilizing mechanism of this invention.
Figure 2:
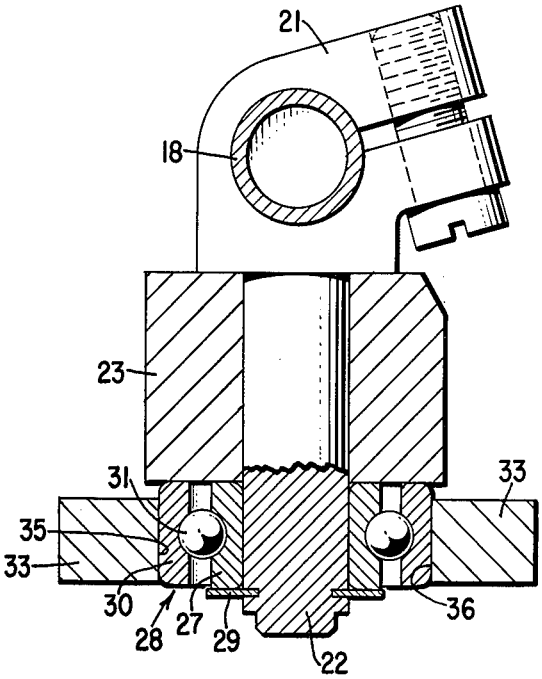
FIG. 2 is an enlarged cross sectional view taken substantially along line 2—2 of FIG. 1.

Referring particularly to FIG. 1 of the drawings, a sewing machine is illustrated having a frame including a bed 11, a standard 12 rising from the bed and sustaining a bracket arm 13 overhanging the bed and terminating in a sewing head 14.

An arm shaft 15 is supported for rotation in the bracket arm and carries a counterbalance 16 with a crank pin 17 for reciprocating a needle carrying bar 18 which is endwise slidably mounted in bearings such as bearing 19 in the sewing head.

Secured to the needle carrying bar 18 by a split clamp 21 is a transverse drive stud 22 which is embraced by a hub 23 at the lower extremity of a connecting link 24 which at the upper extremity is formed with a hub 25 embracing the crank pin 17.

The hub 23 of the connecting link 24 embraces the transverse drive stud 22 of the needle carrying bar. The transverse drive stud 22 also accommodates the inner race 27 of a cylindrical antifriction bearing indicated generally at 28. Preferably the inner race 27 of the antifriction bearing is force fitted on the drive stud 22, however, a spring clip 29 may also be provided on the drive stud 22 to retain the antifriction bearing thereon.

Preferably, the antifriction bearing 28 is a commercially available ball or roller bearing including an outer race 30 and spherical bearing elements 31 arranged between the inner and outer races.

The outer race 30 of the antifriction bearing is arranged in a guide slot 32 formed in a guide member 33 which is secured by fastening screws 34 to the sewing head of the machine frame so as to position the side walls 35 and 36 of the guide slot 32 in parallel relation to the needle carrying bar 18.

Figure 3:
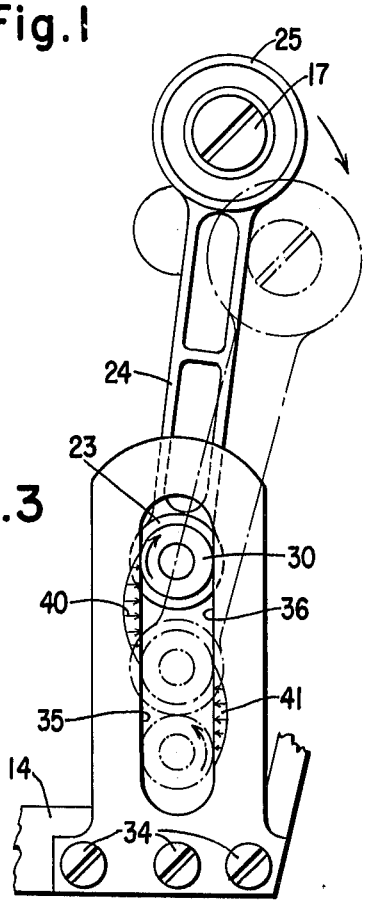
FIG. 3 is a diagrammatic elevational view of the needle reciprocating mechanism of this invention showing the resolution of forces between the stabilizing antifriction bearing and the guide track during the down stroke of the needle bar.

As shown diagrammatically in solid lines in FIG. 3 is a representation of the needle bar driving device while the crank pin 17 being rotated in the direction of the arrow is accelerating the needle bar downwardly. This downward accelerating the needle bar downwardly. This downward acceleration of the needle bar when the sewing machine is operated at substantially constant speed occurs for slightly more than one quarter revolution of the arm shaft during which time the outer race 30 of the antifriction bearing 28 will maintain rolling contact with the left hand side wall 35 of the guide slot 32 giving rise to resultant forces 40 substantially as shown in FIG. 3 and causing the outer race 30 of the antifriction bearing to turn in a clockwise direction.

The crank position shown diagrammatically in dot and dashed lines in FIG. 3 is the position in which the maximum velocity will be imparted to the needle bar following which upon continued rotation of the crank, the needle bar will be decelerated to a standstill at the bottom of its stroke. During such deceleration of the needle bar in its downward stroke and because of the inertia of the needle bar, the resultant forces 41 will be generated substantially as shown in FIG. 3 causing the outer race 30 of the anti-friction bearing to maintain rolling contact with the right hand side wall 36 of the guide slot 32 and bringing about a rotation of the outer race 30 of the antifriction bearing in a counter-clockwise direction.

Figure 4:
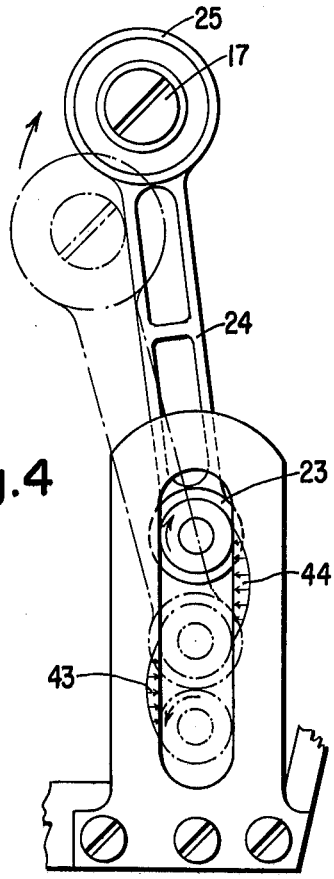
FIG. 4 is a diagrammatic elevational view similar to that of FIG. 3, but showing the resolution of forces between the stabilizing antifriction bearing and the guide track during the up stroke of the needle bar.

Referring to FIG. 4 which illustrates diagrammatically the condition which will apply during the upward movement of the needle bar, it will be appreciated that for a crank pin 17 movement of slightly less than a quarter revolution from bottom dead center the needle bar will be accelerated upwardly and the resulting forces 43 will be generated in the guide member 33 along the slot side wall 35 as shown. From the point illustrated in dot dash lines in FIG. 4 in which the maximum velocity will be imparted in the needle bar upwardly, the needle bar will be decelerated upwardly and the inertia in the needle bar will give rise to the resultant forces 44, as shown in FIG. 4, to the antifriction bearing causing the antifriction bearing outer race to turn in a clockwise direction.

Because the stabilizing antifriction bearing moves from one side to the other side of the guide slot on both the upward and downward strokes of the needle bar, the antifriction bearing consequently will turn in opposite directions during each of these reversals which will have the effect of distributing the wear because the line of contact of the antifriction bearing on the guide member will be constantly shifting in opposite directions about the bearing.

It will be noted that at three positions during each stroke of the needle bar, namely at the extreme top, somewhere approximately at the middle of the stroke, and at the extreme bottom, there will be substantially no lateral forces acting between the stabilizing antifriction bearing 28 and the guide member 33. Particularly at these three positions in which lateral forces are absent, slight precessing motions will occur between the outer and inner bearing races resulting for instance, from inertia of the outer race or the like. As a result, the location of the line of contact of the bearing outer race 30 with the guide slot side walls 35 and 36 will continuously be changing and this will contribute to a uniform distribution of wear evenly about the entire bearing and a consequent long bearing life.

Having set forth the nature of this invention, what is claimed herein is:

1. A needle bar drive stabilizing arrangement for the needle bar reciprocating mechanism of a sewing machine having a frame, a drive shaft journalled in said frame and carrying a crank pin, a needle carrying bar endwise reciprocally mounted in bearings in the frame and having a lateral drive stud secured thereon, and a connecting link having at one extremity a hub embracing the crank pin and at the other extremity a hub embracing the drive stud which is secured on the needle bar, and a guide member fastened to the machine frame and formed with a guide slot having sidewalls parallel to the needle carrying bar one at each side of the drive stud, characterized by this that a cylindrical antifriction bearing is provided of which the inner bearing race is fitted on the drive stud and the outer bearing race is arranged with clearance between the guide slot sidewalls so that during each stroke of the needle bar the outer bearing race will be urged into rolling contact with one guide slot sidewall during acceleration of the needle bar and into rolling contact with the opposite guide slot sidewall during deceleration of the needle bar.

* * * * *